United States Patent [19]

Perry, deceased

[11] 4,062,471

[45] Dec. 13, 1977

[54] CONTAINER WITH ATTACHED CLOSURE

[76] Inventor: Walter Merton Perry, deceased, late of 76 Locust Hill Road, Darien, Conn. 06820, by Elizabeth D. Perry, executrix

[21] Appl. No.: 717,993

[22] Filed: Aug. 26, 1976

Related U.S. Application Data

[63] Continuation-in-part of Ser. No. 712,839, Aug. 9, 1976, and a continuation-in-part of Ser. No. 515,444, Oct. 17, 1974, which is a continuation-in-part of Ser. No. 231,124, March 2, 1972, Pat. No. 3,843,011, which is a continuation-in-part of Ser. No. 514,069, Oct. 11, 1974, Pat. No. 3,952,912, which is a continuation-in-part of Ser. No. 231,124, March 2, 1972, Pat. No. 3,843,011.

[51] Int. Cl.[2] ..... B65D 41/32

[52] U.S. Cl. ..... 220/269

[58] Field of Search ..... 220/268-273, 220/277; 222/541

[56] References Cited

U.S. PATENT DOCUMENTS

| | | | |
|---|---|---|---|
| 3,836,038 | 9/1974 | Cudzik | 220/269 |
| 3,967,752 | 7/1976 | Cudzik | 220/269 |
| 3,967,753 | 7/1976 | Cudzik | 220/269 |
| 3,977,561 | 8/1976 | Strole et al. | 220/269 |

*Primary Examiner*—George T. Hall
*Attorney, Agent, or Firm*—Kane, Dalsimer, Kane, Sullivan and Kurucz

[57] ABSTRACT

Improved easy open means for containers. Especially adapted to those used for liquids, including carbonated beverages, and permitting drinking from the container or pouring out contents. An important feature is attachment of closure to container after opening to avoid litter. Main feature is an openable segment in the top defined by a score line that extends almost all around its periphery, but interrupted at one point by an unscored section which provides integral hingeable attachment means to secure the segment to the top within the container after opening. Opening of the segment is accomplished by a manually operated elongated leverage lift tab which is hingeably secured to the top by a rivet which is positioned just outside of the segment and close to the score line. The outer longer lift end of the lift tab extends over the container top beyond the segment, and the shorter inner end extends partially over the segment, and comprises a downward pressure exerting extension. When the lift end is raised, the inner end exerts high downward pressure near the score line, thereby rupturing the score line with the rupture starting near the pressure point and extending on around the periphery, and the segment is thereby hinged down into the container where it remains attached to the top by the hingeable unscored section. The lift tab is then folded back out of the way to a position just overlying the container top, and ready for drinking from the can or pouring out the contents. Other features include various lift tab pressure exerting means, depression in top for lift tab, angular positioning of lift tab for improved rupturing and less obstruction to the user, part of score line replaced by adhesive sealing for easier initial rupture, various means for stiffening segment and top.

19 Claims, 51 Drawing Figures

CONTAINER WITH ATTACHED CLOSURE

This application is a continuation-in-part of my co-pending application Ser. No. 712,839, filed Aug. 9, 1976, and also a continuation-in-part of my co-pending application Ser. No. 515,444, filed Oct. 17, 1974, and which is a continuation-in-part of my application Ser. No. 231,124, filed Mar. 2, 1972, and now U.S. Pat. No. 3,843,011, issued Oct. 22, 1974; which is a continuation-in-part of Ser. No. 514,069, filed Oct. 11, 1974, and now U.S. Pat. No. 3,952,912, issued Apr. 27, 1976, which is also a continuation-in-part of my application Ser. No. 231,124, filed Mar. 2, 1972, and now U.S. Pat. No. 3,843,011.

BACKGROUND OF THE INVENTION

1. Field of the Invention

This invention relates to easy opening means which is provided in the end of a can or similar container, by which the can can be opened without resorting to a separate tool or device which is not part of the can assembly. It relates to easy opening means which remains attached to the container after opening. It is concerned particularly to containers for liquids which are normally consumed directly from the can, and which may be under internal pressure before opening.

2. Description of Prior Art

The opening means generally used heretofore results in a separate piece being completly removed from the can end, and which is then discarded. In the most common form, the can end is made of aluminum, and an openable segment is defined in the end by score lines, made by cutting the metal part way through in the outline of the removeable segment. A leverage ring shaped tab is usually attached to the inner end of the segment by an integral rivet. When the tab is raised, the high leverage breaks the score line at the small rivet end, and once rupture is initiated, the remainder of the segment is torn out by pulling on the tab. There are four principle disadvantages to this device. One is the sharpness of the opening left in the can end because of the torn metal, another is the damage to the environment when the piece is discarded, another is the danger to bare feet from the sharp segment if discarded on the ground, as at beaches, and a fourth is the cost of the extra metal for the lifting tab.

BRIEF SUMMARY OF THE INVENTION

It is a primary objective of the invention to provide an easy opening means for a container in which the openable segment as well as the leverage lift tab for effecting opening remain attached to the container, so they will not be discarded separately. Another primary objective of the invention is to provide an opening method which is easy to operate and does not require much force. Another objective is to provide means so after opening both the lift tab and the segment are positioned where they will not obstruct pouring out the contents, or drinking from the container.

A further objective of the invention is to form the openable segment from the material of the container end itself to save on material and to provide firm attachment of the segment to the container after opening. Another objective of the invention is to fold the segment down within the container where it remains attached securely to the top, and out of the way.

Another objective of the invention is to provide an openable segment defined by a score line which extends almost all around its periphery, but with the score line interrupted to leave a short unscored section between the ends of the score line, and which provides a hingeable attachment means to secure the segment to the container top after opening. Another objective of the invention is to provide a leverage lift tab for manual opening of this type of segment, and with the lift tab upwardly hingeably secured to the top by rivet means, preferably integral, and positioned outward of the segment's area but close to the score line, preferably with the score line arching partially around the rivet, and with said lift tab having a longer outward lift end extending over the container top beyond the segment, and with a shorter inner downward pressure exerting end extending partially over the segment, and whereby when the lift end is raised upwardly the pressure end moves down and its pressure contact means cause rupture along the score line, and bending of the segment down into the container to form an opening, and where it remains anchored to the top by the unscored hinge section. Another objective of the invention is to provide means for folding the leverage lift tab back after opening to near its original position close to the container top where it is out of the way for drinking from the can or pouring out the contents.

Another objective of the invention is to provide means whereby initial rupture along the score line is in the region near the rivet. Still another objective of the invention is to provide means whereby initial rupture is along the score line across from the rivet, and separated therefrom by a small outward bulge of segment, and with the pressure contact means close to the further section of score line. Another objective of the invention is to position the lift tab at an angle with the generally oval segment and at its inner end, and for increased final clearance, plus improved leverage action.

Another objective of the invention is to provide the small outward bulge near the rivet, and to cut through the bulge arc of score line, reform the material to provide a slight overlap, and then seal the through cut section with frangible sealant means, and thereby provide an initial rupture section requiring less force to open than score line at this point.

Still another objective of the invention is to provide rib or groove stiffening means in the segment to assist in transfer of the downward score rupturing pressure along the length of the segment. Another objective is to provide stiffening ribs or grooves in the material of the top, especially near the rivet.

Another objective of the invention is to provide small radial score lines in the segment near the rivet, and extending from the main score line a short distance into the segment, and in order to reduce the pressure required for initial score line rupture in this region.

Another objective of the invention is to provide elongated lift tab leverage means to start opening a segment defined by an interrupted score line, and with the leverage tab and the segment both remaining attached to the container top after opening.

Another objective of the invention is to make the container top of sheet material, and which material may be aluminum alloy, steel, or plastic, and if plastic may be injection molded.

BRIEF DESCRIPTION OF THE DRAWINGS

Other objectives and advantages of the invention will become apparent from the description given in the specification and by reference to the following drawings.

DESCRIPTION OF THE PREFERRED EMBODIMENTS OF THE INVENTION

Figure 1:
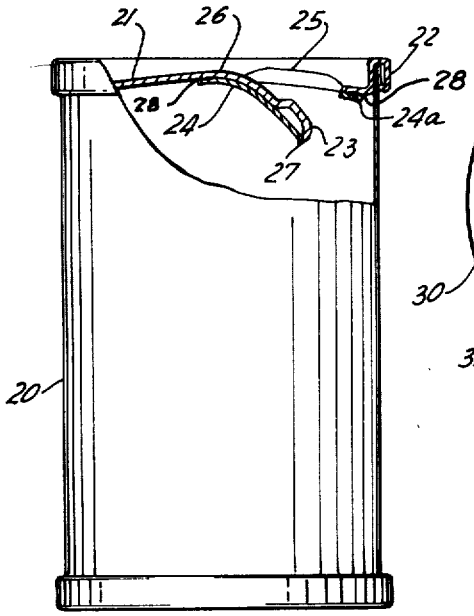
FIG. 1 is an elevation of a container with a closure shown in cross-section which is made in accordance with this invention, and which is shown in the opened position, with the closure remaining attached.

Referring now to the drawings, FIG. 1 illustrates a typical can or container with an opening device in accordance with my invention and shown in its opened position. The container wall 20 is fastened to the top 21 by rolled joint 22. The openable segment 23 is shown bent down and still attached to the can top by uncut part 26. The raised boss on the tab assists in pushing the segment down to open, cutting the aluminum foil sealing patch 24, which is held and sealed to the can top by circle of adhesive 28. The tab has a sharp edge 27 to more easily start cutting the foil, leaving strip 24a of the foil on the can top. Raised rib 25 served to support one edge of the tab against internal pressure in the can.

Figure 2:
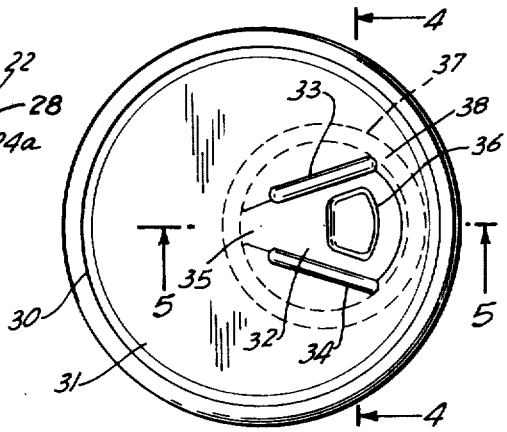
FIG. 2 is a plan view of a container showing one type of closure arrangement in the closed position, and which is in accordance with this invention.
Figure 3:
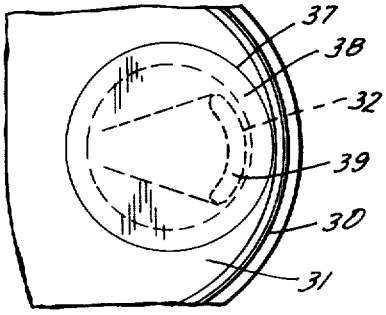
FIG. 3 is a view of the FIG. 2 type of closure, but viewed from the under side of the can top.

FIG. 2 shows an end view of can 30 with top 31, raised ribs 33 and 34 on the top alongside and overlapping the tab, raised boss 36 on the tab, tab 32 which is punched cut from the top 31, except for connecting strip 35, and sealing patch 37 underneath where it is fastened and sealed to the underside of top 31 by adhesive ring 38. FIG. 3 is a view of the underside of the cover showing patch 37, adhesive ring 38, tab 32 and supplementary adhesive area 39. Patch 37 may preferably be of aluminum foil, and the adhesive may be of the hot melt type. By adhesively attaching the patch to the tab at 39, the patch is cut away more cleanly when the tab is depressed to open. The patch of aluminum foil is air-tight to prevent leakage, and since the tab cannot move up under internal pressure, it serves to support the foil also against rupture from internal pressure.

Figure 4:
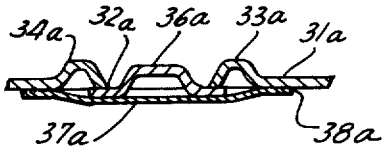
FIG. 4 is a cross-section taken along line 4—4 of FIG. 2.
Figure 5:
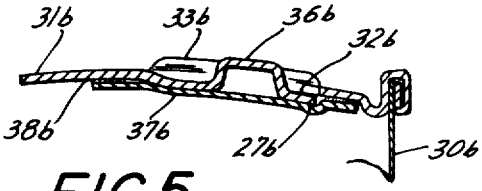
FIG. 5 is a cross-section taken along line 5—5 of FIG. 2.

FIG. 4 is a cross-section taken along line 4—4 of FIG. 2, and shows overlapping raised ribs **33*a* and 34*a*, and tab 32*a* with boss 36*a*. The aluminum foil patch 37*a* is held by adhesive ring 38*a*. FIG. 5 shows a cross-section taken along line 5—5 of FIG. 2, with the tab in the closed position, and with can wall 30*b*, can top 31*b*, tab 32*b* with boss 36*b*, rib 33*b*, and patch 37*b* held by adhesive lines 38*b*. The can is opened by pushing down on the boss 36*b* of the tab 32*b*, the sharpened protruding edge 27*b*** of the tab cutting the aluminum foil with very little effort.

Figure 7:
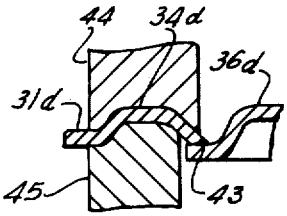
FIG. 7 is a cross-section showing the second step in forming the ribs for the FIG. 2 closure to make the opening smaller than the tab closure piece.
Figure 8:
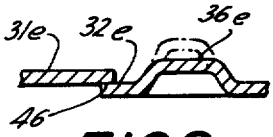
FIG. 8 is a cross-section showing an alternative method, in which the tab is made wider than the opening in the can top.

As shown in FIG. 4, the tab is wider than the opening in the top to resist inner pressure in the can from raising the tab or straining the aluminum foil. Since the tab is cut from the can top, and would be slightly smaller than the opening, a sequential pressing operation is required as shown in FIGS. 6, 7 and 8, to either reduce the width of the opening, or increase the width of the tab.

Figure 6:
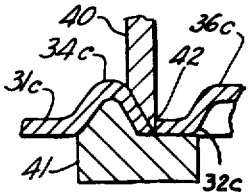
FIG. 6 is a cross-section showing the method of cutting the closure tab from the can top for the type of closure shown in FIG. 2.

FIG. 6 is a cross-section through a rib and the adjoining edge of the tab, similar to FIG. 4, and shoows the method of forming. An upper die cutting blade 40 has cut rib **34*c* from tab 32*c* at 42, and opposing die member 41 supports the piece while it is being cut. This section can be taken along 4—4 in FIG. 2. The tab boss is 36*c*. A second press operation is shown in FIG. 7 and is taken along line 4—4 of FIG. 2. A press die 44, with opposing die 45, lowers and spreads the previously formed narrow rib to width 34*d*, so the right edge of the rib moves over to overlap the tab at 43. The tab boss is 36*d*. An alternative way to make the width of the tab greater than the opening in the top is shown in FIG. 8. In this case the boss on the tab is initially formed higher than required and the crown lowered to 36*e* in a second pressing operation, spreading the tab 32*e* width to overlap the opening in cover 31*e* at 46**. These views show the operation for one edge, and the other edge of the tab is formed the same, simultaneously. The can top is made of relatively soft aluminum, and formation of ribs by pressing does not significantly reduce the strength of the top, even though the thickness of the metal is reduced to a small degree. Actually the ribs increase the rigidity of the top.

Figure 9:
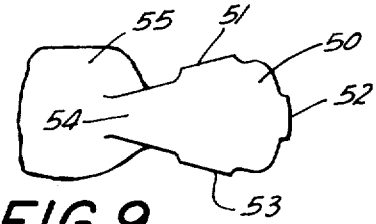
FIG. 9 is a plan view of a portion of a can top in which the closure tab is widened in several places by pressing.

FIG. 9 shows another way to cut the tab from the top of the can, and to enlarge its area so when postioned under the can top it resists internal pressure. A tab 50 is cut from top 55, and has three extensions 51, 52 and 53 around its periphery, which are formed by impact in a press, spreading the metal in the tab outwardly to form the projections, as shown. The tab remains attached to 55 at 54.

Figure 10:
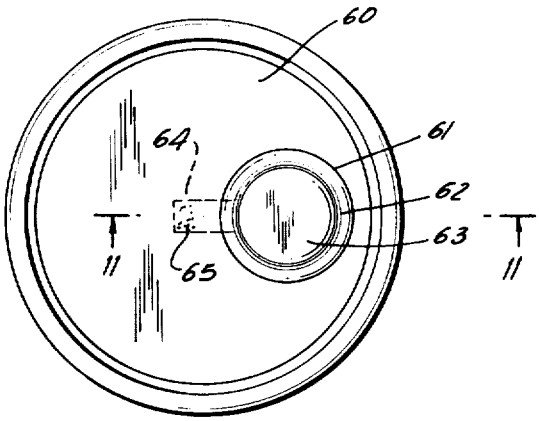
FIG. 10 is a plan view of a can top incorporating an alternative method of constructing a button type closure, with a plug and gasket arrangement.
Figure 11:
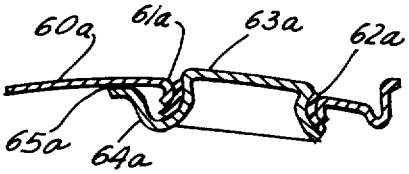
FIG. 11 is a cross-section taken along line 11—11 of FIG. 10.

FIG. 10 shows a plan view of a can top with an alternative method of constructing a plug closure in keeping with this invention. FIG. 11 is a cross-section taken along line 11—11 of FIG. 10.

Referring to FIG. 11, a round opening **61*a* with curved edges is press formed in the top 60*a* of the can. A plug 63*a* is made of aluminum and a circular gasket 62*a* is adhesively attached to the plug. The gasket may be of polyvinyl chloride. The plug is sized to fit snugly in the hole with the gasket forming the seal. Pressure from inside the can increases the sealing effect. The plug should be formed to give resilience to compression, and it should have an extending tab 64*a* which is adhesively secured to the underside of the can top by adhesive 65*a*. When the plug is pushed in to dispense the can contents, it swings down and is held from dropping by the tab extension. The plug 63*a*** can also be plastic.

FIG. 10 shows this design in plan view. The can top 60 has opening 61 filled by plug 63 and sealed by gasket 62. Extension 64 is held to the underside of the can top by adhesive 65.

Figure 12:
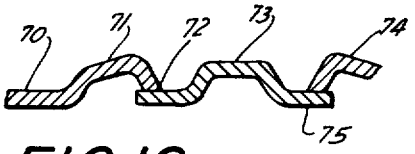
FIG. 12 is a cross-section showing another configuration of the opening in the can and the tab for a FIG. 2 type of closure.

FIG. 12 shows a variation in forming the tab used in the design shown in FIG. 2. The can top 70 has two raised ribs 71 and 74 which have been spread inwardly to reduce the width of the opening so tab 75, which was cut from the metal of the top cannot move up through under pressure. In this variation the legs of the ribs are raised upward so the bottom of the tab and the bottom of the can end are level in line. 73 is a boss to facilitate pushing the tab down.

Figure 13:
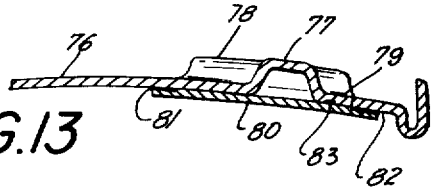
FIG. 13 is a cross-section showing the FIG. 2 configuration assembled in the can top.

FIG. 13 is a cross-section which shows the FIG. 12 configuration completed. Can end 76 has rib 78 which prevents the tab from moving up by overlapping its long edge. 80 is an aluminum foil patch under the openable area. It is sealed by hot melt adhesive ring 81 and 82. The tab 79 is flush with the can top, and it has boss 77. The aluminum foil is also adhesively attached to the underside of the tab at 83 to insure the right hand edge of the tab shearing the aluminum foil when it is pushed down, and preventing the foil from stretching and slipping rather then cutting through at the outer end of the tab to leave the opening clear of foil.

Figure 14:
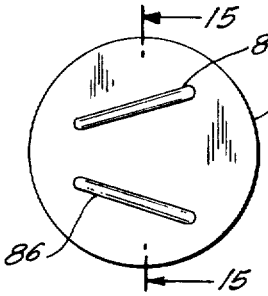
FIG. 14 is a view of a pressure sealing patch used to cover the underside of the closure area to prevent leakage.
Figure 15:
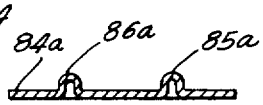
FIG. 15 is a cross-section taken along line 15—15 of FIG. 14.

FIG. 14 shows an aluminum foil patch 84, which has been pressed to raise two ribs 85 and 86. FIG. 15 is a cross-section taken along line 15—15 of FIG. 14, and shows disc **84*a* with raised ribs 85*a* and 86*a***. When the patch is applied to the underside of a can top, the ribs are aligned with the side edges of the opening. They provide slack in the foil, so when the tab is pushed down to open the can, there is no resistance along the side edges, and only at the end. This reduces the amount of pressure required to push the tab down and break the foil.

Figure 16:
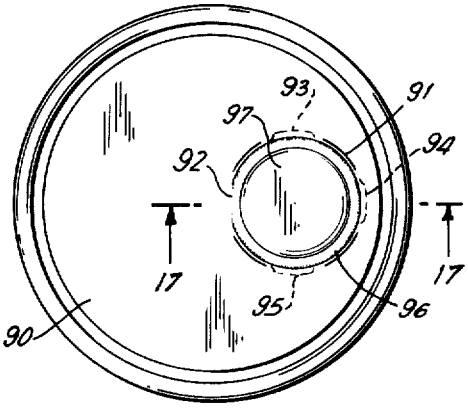
FIG. 16 is a plan view of a can end showing still another closure means in keeping with the invention, and with closure sealed by adhesive.
Figure 17:
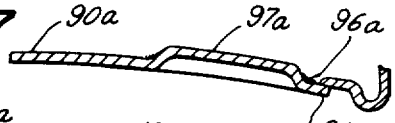
FIG. 17 is a cross-section taken along line 17—17 of FIG. 16.

FIG. 16 is a view of a can top 90 illustrating another form of the invention. A partial hole 91 with rounded edges is punched in the top. The cut extends almost all the way around the circumference, but a narrow section 92 is left uncut to serve as a support when the plug 97 is pushed down to open the container. In a secondary press operation the edges of the central cut-out are expanded outward by impact at three points 93, 94, and 95. This enlargement of the plug provides engagement with the circular wall of the opening to prevent the plug from moving upward under pressure built up in the can. FIG. 17 is a cross-section taken along line 17—17 of FIG. 16, and shows can top **90*a*, circular cut-out 97*a* with raised center, and overlap 94*a* to hold the plug from upward movement. The plug is sealed around its outer edge by adhesive at 96*a* in FIG. 17, and 96 in FIG. 16. The adhesive may be of the hot melt type, and formulated for limited strength so the button can be pushed down easily, with the finger to open the can. It is held in the hinged-down position by connection 92** after opening.

Figure 19:
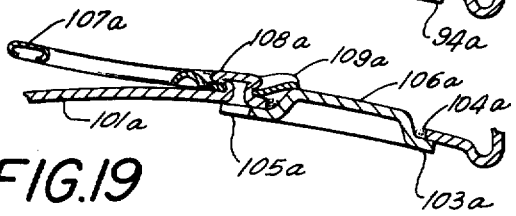
FIG. 19 is a cross-section taken along line 19—19 of FIG. 18.
Figure 18:
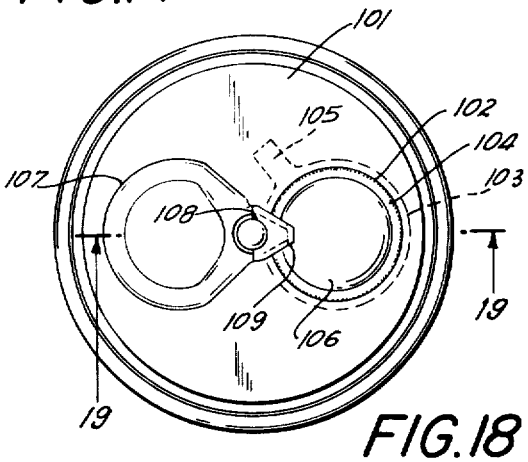
FIG. 18 is a plan view of a can end showing leverage means to assist in opening the closure.

When a plug is sealed in an opening in a container top by an adhesive, it is found that the preferred and easiest opening procedure is to concentrate pressure at one point in the periphery. Once the break starts at this focal point, the rest of the glue line shears off very easily. FIG. 18 is a plan view of can top 101, which has a punched rounded edge hole 102 arranged for an opening for the container for pouring out the contents or drinking direct from the can. FIG. 19 is a cross-sectional view taken along line 19—19 of FIG. 18, and shows a raised plug **106*a*, with outer skirt 103*a* which is larger than the opening in the top 101*a*, and the plug has an extension 105*a* which is adhesively secured to the underside of the top. The joint between the plug and the top is sealed by adhesive along line 104*a*. FIG. 18 shows these respective parts at 102, 103, 104, 105, and 106, and also shows a ring pull member 107, which is fastened to top 101 by integral rivet 108, and has an extension 109 arranged to press downward with high leverage when the ring is raised. It presses at one point on the plug periphery and starts the break in the adhesive line holding the plug. In FIG. 19 these parts are 107*a*, 108*a*, and 109*a***.

Figure 20:
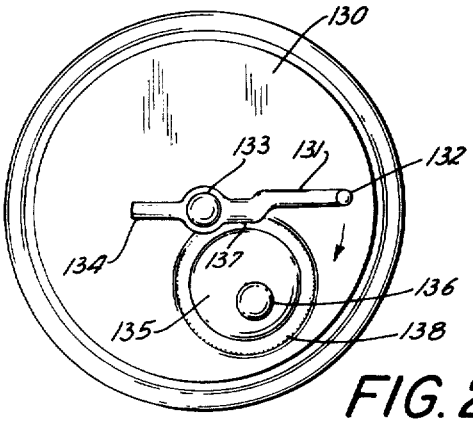
FIG. 20 is a plan view of a can end in which mechanical means are provided to assist in pressing down the closure button.

FIG. 20 shows can top 130 with plug 135, which has a lower skirt larger than the circular opening in the top, and sealed against leakage by adhesive 138. There is a raised point 136 on the top of the plug. An opening bar 131 is provided to make opening easier. It has finger operating extension 132, and is mounted to swivel on integral rivet 133, which is drawn from the cover material external of the opening. Bar 131 has extension 134 to exert pressure against the can top to obtain leverage to press against the plug without tilting the rivet. When arm 131 is moved in the direction of the arrow, shoulder 137 presses first against the crown of the plug, starting to break the adhesive line at this point. Further movement of the bar brings the underside of 131 up against crown 136, and this pushes the plug down into the can, where it hangs tilted and held by an adhesively anchored extension, not shown, but similar to that shown in FIG. 18 at 105.

Figure 21:
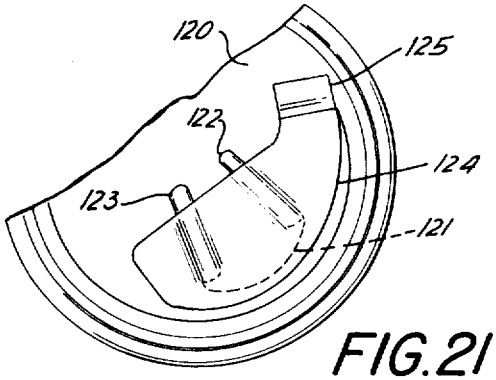
FIG. 21 is a view of a can end with a removable adhesive patch over the top of the closure to prevent premature opening and to give protection from contamination.

FIG. 21 shows a patch 124 of paper or foil held by pressure sensitive adhesive to the top surface over an opening arrangement such as the one shown in FIG. 2. It serves two purposes, one to keep the area clean where the lips contact it, and the other to prevent pressure from above encountered during shipping and handling for pushing the tab down prematurely.

Figure 22:
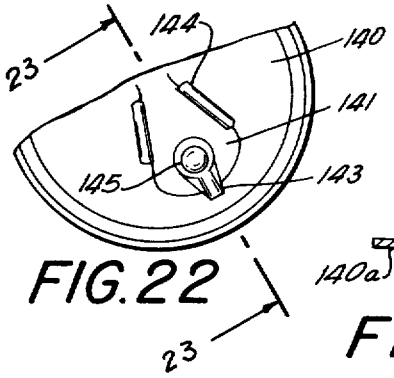
FIG. 22 is a view of a can top end showing a locking device for the openable segment to prevent premature opening.
Figure 23:
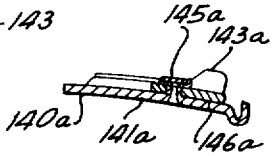
FIG. 23 is a cross-section taken along line 23—23 of FIG. 22, showing further details of construction.

FIG. 22 illustrates a tab safety locking means. It shows can top 140 with openable tab 141, ribs 144, and swivel locking arm 143 mounted on integral rivet 145 which is drawn from the metal of the tab. FIG. 23 is a cross-section taken along line 23—23 of FIG. 22. It shows arm **143*a* on rivet 145*a*, can top 140*a*, tab 141*a*, and the shoulder of the top at 146*a***, where the locking arm engages the shoulder so the tab cannot be pushed down inadvertantly. To open the can, the locking arm is first rotated 180°, and then the tab pushed down. The tab may be sealed by a patch underneath as previously described.

Figure 24:
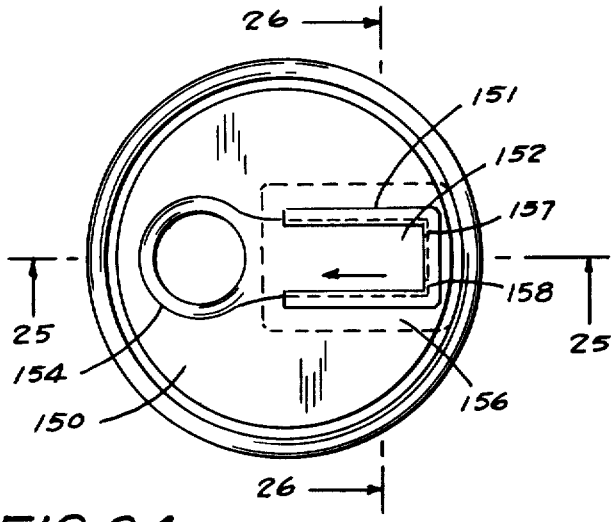
FIG. 24 is a view of a can end showing another form of opening device in accordance with the invention, and which comprises a sliding gate arrangement.

Another method of opening a pressure container, and in which the opening member stays adhered to the can, is shown in FIG. 24, viewed from the top. A can top 150 has a metallic slide member 152, arranged to slide in frame 151. To open the can the slide is drawn over in the direction of the arrow by pulling on ring 154 far enough to expose a pouring or drinking rectangular opening. In this position the slide stays fastened to the can top. At the same time it can be closed again, but not pressure sealed. By making 151 an inserted piece, the can top may be of steel, and 151 of aluminum. Alternatively, the can top may be aluminum, and with the slide guides formed directly in the can top material.

The construction in which the slide guides are formed from the material of the top applies also to other material than aluminum, such as tin plated steel or steel which has any other protective coating. This integral construction is also described again below in connection with FIGS. 29, 30, and 31.

Figure 26:
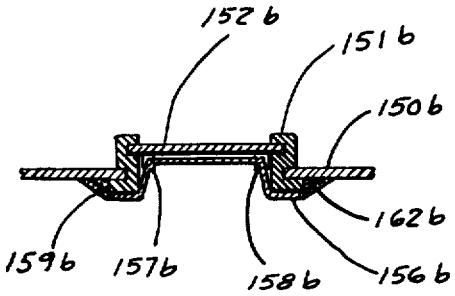
FIG. 26 is a cross-section taken along line 26—26 of FIG. 24, and gives further details on the gate arrangement.
Figure 25:
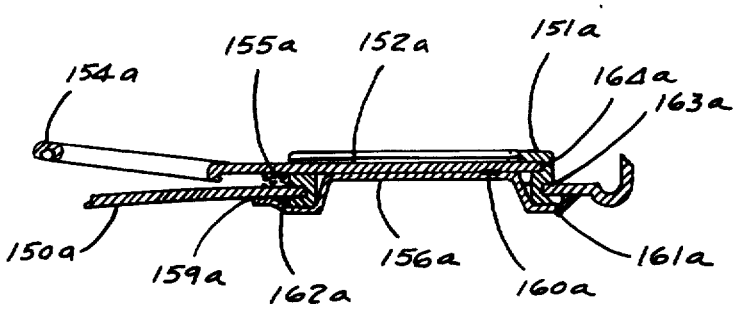
FIG. 25 is a cross-section taken along line 25—25 of FIG. 24, showing how the gate is mounted and sealed against leakage.

Further details are shown in FIG. 25, which is a cross-section taken along line 25—25 in FIG. 24, and FIG. 26, a cross-section along line 26—26 of FIG. 24. An aluminum frame 151 is fitted in a rectangular opening in the can top. Referring to FIG. 25, frame 151*a* has a lower groove 163*a* around four sides and is sealed to top 150*a* by adhesive 162*a*. This frame is formed with an upper groove 164*a* which extends around three sides, but leaving out the groove upper half 151 on the short side at the can center. The metal slide 152*a* slides in this groove, and has ring end 154*a*. Referring to FIG. 24, the slide has two turned down legs at 157 and 158 which serve to break aluminum foil patch 156 as the slide starts to move.

FIG. 26 is a section taken along line 26—26 of FIG. 24. It shows legs 157*b* and 158*b*, and the aluminum foil patch is at 156*b*, held to top 150*b* by adhesive line 159*b* around its periphery. There may also be a metal point formed at 161*a*, FIG. 25, protruding from frame 151*a* on the underside to help start a break in the aluminum with light pulling pressure on ring 154*a*. The foil is also adhered to 152*a* and 160*a*, so as the slide moves out it carries the inner piece of foil with it, and legs 157 and 158 shear the thin foil along the sides of the opening. A weak adhesive is placed at 155*a*, FIG. 25 to prevent the possibility of anything from the outside getting under the slide, and if desired a light wax coating can be placed along the top outside edges of the slide to keep out any foreign substances.

Figure 27:
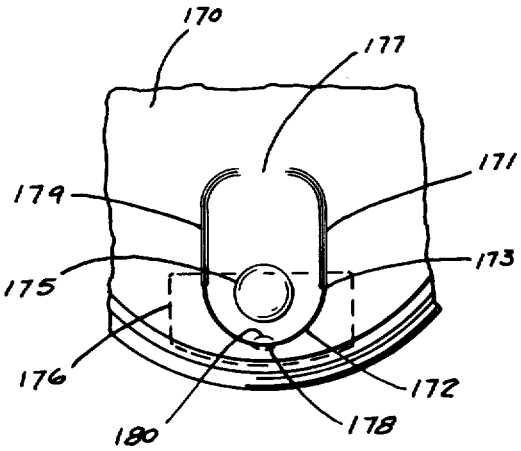
FIG. 27 is a view of a can top end and shows another variation in accordance with the invention, and one in which the segment outline is partly score line and partly cut through the top material.

Still another means to construct the push down segmental arrangement is shown in FIG. 27, which is a plan view of the can top 170. Two score lines 171 and 179 are cut in the metal of the can top. Connecting directly to the ends of the score lines is cut 172, which extend through the thickness of the top. The cut is across the end of the segment and part way up the sides, up to point 173 of score line 171. A boss 175 is formed in the segment and serves as a point on which to exert a pushing pressure with the finger to open the segment. A small bump is formed initially at 180 in the segment, and it is then flattened out after the end cut is made, and with the end of the segment slightly depressed, causing the metal of the segment to extend out at 178. Extension 178 is now just below the metal at the edge of the can top, and it serves to resist internal pressure from pushing the segment up. There can be several extensions similar to 178, or a rib can be pressed in to overlap as in FIG. 7. The open cut 172 is sealed on the underside by an aluminum foil patch 176 adhesively attached to the underside of the top, or alternatively the cut 172 can be sealed by adhesive, preferably on the underside.

This segment is opened by pushing on the boss 175, breaking the foil, and then shearing the metal of the top along the two score lines. After the segment is pushed down, unscored area 177 holds it in its inclined position within the can. By providing a through cut as a starter, it takes much less pressure to shear along a score line. For instance, once the shear is started in this way, it takes only 4 to 5 pounds pressure to push a segment down and shear the two score lines. In the can opening means in common use heretofore, where the score is continuous around the periphery of the segment, it takes 20 to 25 pounds pressure to start a break in the score line, even at the very small arc where the integral rivet and pressure point is usually located near the center of the can.

Figure 28:
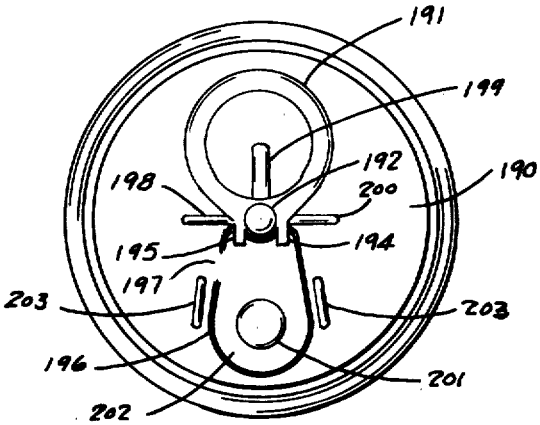
FIG. 28 is a view of a can top with a segment defined by a score line, and with leverage means to start fracture of the score line, and push button means to complete the opening operation.

Another design in keeping with the invention is shown in FIG. 28. A container top 190 has an openable segment 202 defined by a score line 196 which extends around the periphery of the segment except at point 197, where a narrow band of metal remains intact when the closure is opened to support the segment tilted down within the container. A raisable leverage ring arm 191 is secured to the can top by integral rivet 192, which is formed just outside the segment at the score line, and which continues to hold the arm 191 after the segment is opened. It is folded back flat to facilitate drinking from the can.

The score line is brought very close to the rivet, preferably around it, and legs 194 and 195 of the ring arm press with high leverage against the end of the segment when the ring is raised, causing the score line to break, and the end of the segment to move down. Once fracture occurs, the remainder of the segment is pushed down easily by pressing on boss 201. Ribs 198, 191 and 200 reinforce the rivet and ribs 203 protect the sharp edge at the segment opening.

Figure 29:
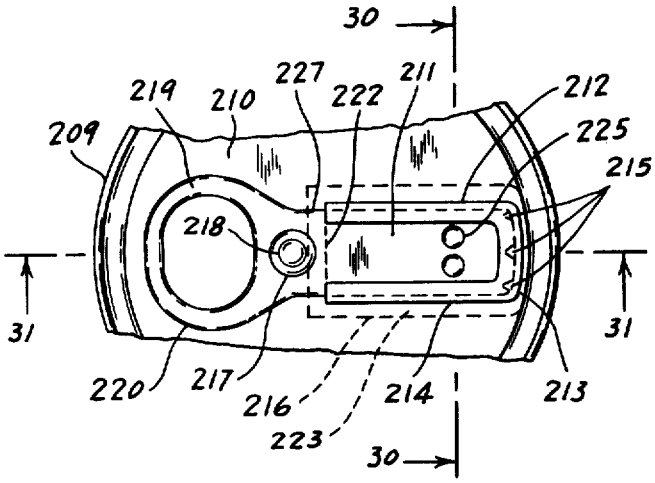
FIG. 29 is a partial plan view of a can end panel showing another form of the sliding gate arrangement in accordance with the invention, and also showing an optional pressure release device.
Figure 30:
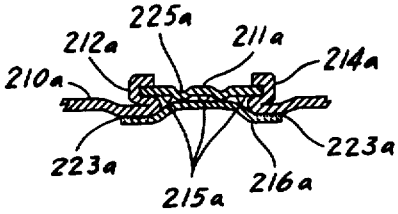
FIG. 30 is a partial cross-section taken along line 30—30 of FIG. 29, showing how the gate guides are formed from the material of the can end panel, and how the gate is sealed.
Figure 31:
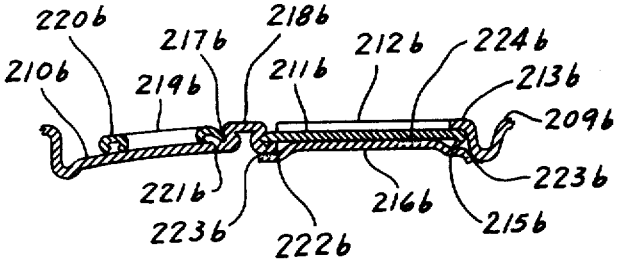
FIG. 31 is a partial cross-section taken along line 31—31 of FIG. 29, showing more details of the construction.

The previously described construction in which a slide member is mounted in a guide frame which is formed from the material of the container top is shown in partial plan view FIG. 29. FIG. 30 is a partial cross-section taken along 30—30 of FIG. 29, and the same parts are marked with suffix *a*. FIG. 31 is a partial cross-section taken along line 31—31 of FIG. 29, with parts having suffix *b*. Container top 210 with rim 209 has slide frame formed from the material of top 210 and with three grooved sides 212, 213 and 214. Slide 211 fits in the grooves and has pull ring 219 formed with rounded edges 220, which also stiffen the sides down to 227.

Optionally a means may be provided for releasing the internal pressure in the container before pulling the slide open. Such a means comprises a small circular easy open segment defined by score line 221*b*. Integral rivet 218 is formed from the metal within the score line, and slide 211 has semi-spherical depression 217 which serves to provide lifting leverage to rupture score line 221 when the ring is raised to start opening the container. Downward projecting dents 225 formed in the slide are positioned to limit the outward movement of the slide when they reach edge 222 to prevent the slide from coming out all the way.

The opening area is sealed by frangible membrane 216, which may be of aluminum foil or other material, and which is sealed airtight all around by adhesive 223. The adhesive may be plastisol, hot melt, polyvinyl chloride, or other type suitable for use with the contents of the container. A plurality of sharp points 215 project downward and are formed on the inner edge of slide 211. They serve to part the membrane when the slide is pulled for opening, and are preferably curved as shown in FIG. 31 at 215*b* so internal pressure does not cause premature rupture of the membrane. Adhesive at 224*b* insures that the inner section of the cut membrane moves out with the slide as the membrane is slit progressively along either side by outer sharp points 215. The membrane may preferably be aluminum foil or tin foil. It is applied with a little slack in such a way that the slide can move out more or less freely until points 215 dig into the foil and initiate gearing it across the end. The membrane may also be attached by pressure sensitive adhesive.

Figure 32:
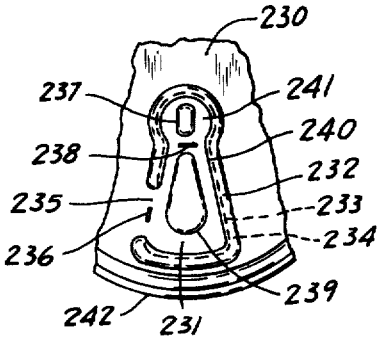
FIG. 32 is a partial plan view of a can end panel showing another form of the invention, and which provides an initial pressure release button area at one end of the segment.

An advantageous design of push in closure is shown in FIG. 32. Closure 231 has an elongated shape with the wider part near the can rim 242, and is cut from the material of container top 230, leaving an uncut attachment section 235. A short section of score line may be formed in section 235 at 236 to make opening easier. The material of 230 is formed into a ridge around the periphery of the opening at 232 to form an opening with rounded edges and to provide a hollow channel underneath for sealant. To withstand internal pressure the outer periphery of the segment, shown dotted at 233, is made larger than opening 240. If the top is of ductile metal this is done by refoming after the peripheral cut is made, either by decreasing the size of the opening or by enlarging the segment, or both. A line of plastisol or other frangible sealant forms an airtight seal around the periphery underneath at 234. Raised areas 237 and 239 facilitate pushing down with the finger.

One advantage of the FIG. 32 arrangement is that initial rupture is much more easily attained by pushing down first on small end 237, which releases any internal pressure. Because of the small area at 241, internal pressure gives minimal resistance, and also the small arc of sealant is easily ruptured. Optional score line 238 makes bending down of the end take less force. Once rupture of a sealant line is started, progressive breaking along the line is easy, and as a result completion of opening by pushing down with the finger on rea 239 takes very little force.

Figure 34:
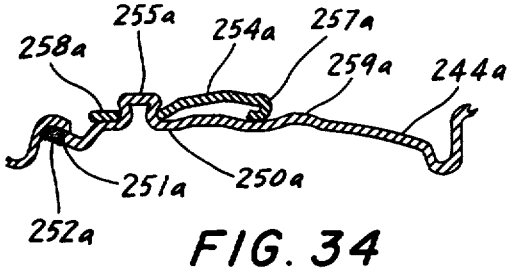
FIG. 34 is a partial cross-section taken along line 34—34 of FIG. 33 giving more details of construction.
Figure 33:
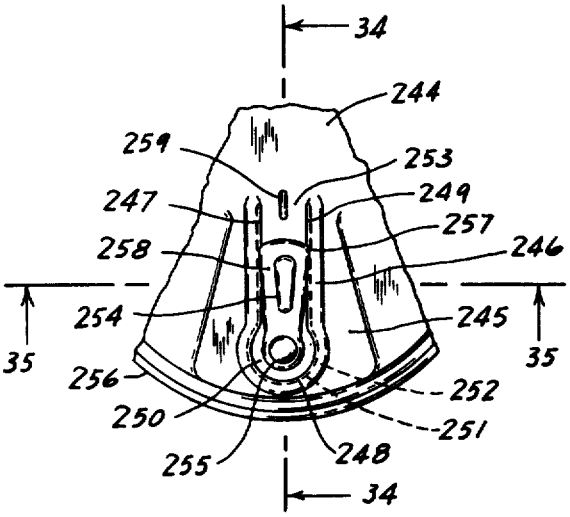
FIG. 33 is a partial plan view showing another very desirable form of the invention, and which provides a small tab attached to an end of the segment to assist the manual opening operation.
Figure 35:
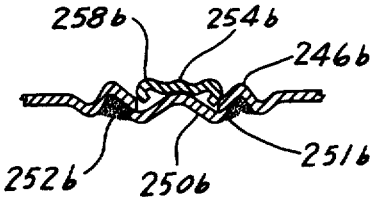
FIG. 35 is a partial cross-section taken along line 35—35 of FIG. 33 showing the metal overlapping and sealing details.
Figure 36:
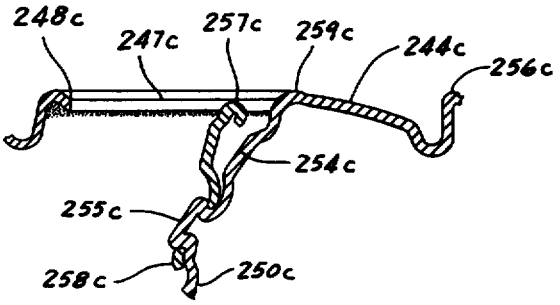
FIG. 36 is a partial cross-section similar to FIG. 34, but showing the final position of the segment and the tab after opening.
Figure 37:
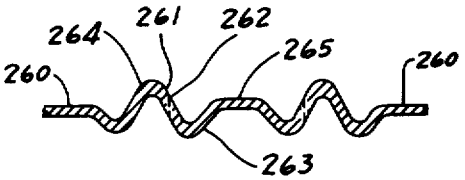
FIG. 37 is a partial cross-section in an area similar to FIG. 35, but showing an initial step in the method of press forming the metal of the can end panel.

FIG. 33 shows a highly preferred arrangement of push in closure made in accordance with the invention, and which has a light and low cost lift tab to facilitate opening. The lift tab assists in the opening operation by providing leverage and also serving to eliminate any possibility of danger to the user, such as a finger getting stuck in the opening when trying to push the segment down with a finger. FIG. 34 is a cross-section along line 34—34, and FIG. 35 is a cross-section along line 35—35, both of FIG. 33 before opening. FIG. 36 is a cross-section similar to FIG. 34, but showing the position of the closure and the lift tab after opening. Container top 244 has raised area 245 so gases instead of liquid will be in this region and internal pressure can be released near the rim. Closure 250 is cut from the material of top 244 to form an opening. The area of the opening near the rim at 248 is large enough for drinking or pouring, and may be circular or any other shape. The opening extends from 248 toward the center of the container to admit air when drinking or pouring. The preferred shape of the extension is with two parallel sides 247 and 249. An uncut section 253 at the inner end serves to anchor the closure to the top when it is hinged down to open. Sides 247 and 249 need not be parallel their whole length, but should preferably be parallel toward the center.

The closure is larger than the opening as shown in FIG. 35. The edges of the opening are rounded at **246*b*, and hollow underneath for frangible sealant 252*b*. Or an adhesively held membrane may be used instead of the adhesive sealant. The edges of the closure at 251*b*** extend out beyond the edges of the opening to resist upward internal pressure.

A lift tab 258 is attached to the outer end of the segment, preferably by integral rivet 255. The center of the lift tab at 254 may be grooved on the underside to match the center ridge of segment 250 to keep the tab in alignment. The width of the outer end of the tab at 257 may be made slightly larger than the space between the parallel section of walls 247 and 249.

Now to open the container, the lift tab is raised, and this bends down the outer edge of the circular section of the closure near the rim, rupturing the sealant, and releasing internal pressure with a pop, which is desirable to keep liquid from squirting out. This is a big advantage over the small separate push button used heretofore to release the pressure. The lift tab is then pushed on down to complete the opening, and with very little force required to progressively tear the two lines of sealant to point 253. The final open position of tab and segment is shown in FIG. 36. The length of the lift tab is designed so it can be pushed all the way through the opening, and once through, it can not come back up because the outer end is wider than the opening between sides 247 and 249 by a slight amount.

The outer end of the tab is then flush with the top of the container, or slightly below, so there is no interference with the user's nose when drinking from the can. A small raised rib 259 in area 253 serves to increase the radius of curvature at the hinge point when the segment bends down and insures against breaking off and the parts falling into the can.

Figure 41:
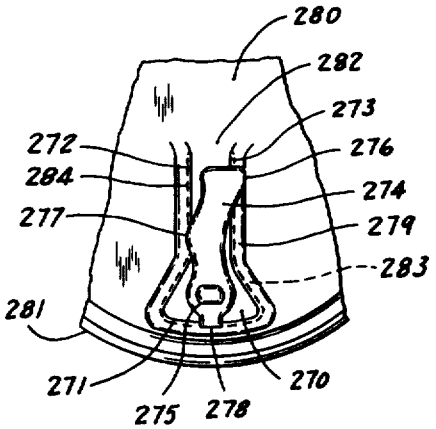
FIG. 41 is a partial plan view of a can end panel showing an alternative and very desirable construction of easy open means using a tab attached to one end of an elongated segment.

FIG. 41 shows an alternative design in which closure segment 270 is also larger than the opening in container top 280, with rim 281. The opening has an outer end 271 for drinking or pouring, and with side walls 272 and 273 extending toward the container center, and they may be parallel as shown. The edges of the opening are rounded at 279, and sealant 283 is underneath. Uncut section 282 acts as a hinge. Lift tab 274 is slightly narrower at its outer end 276 than the space between 272 and 273, but it is positioned slightly off-set and held from rotation by oval rivet 275. Then when the closure and lift tab are pushed down, and the outer end of the lift tab goes below the side walls of the opening, it springs slightly to one side. It catches on the edge of the opening and will not come up again, but stays substantially flush or even below so as not to interfere with the user's nose.

The off-set at 276, and another off-set at 277, plus an optional projection at 278, all serve to block the closure against inadvertent opening during shipping or handling of the container. Extension 278 also serves to keep the tab from being too easy to raise when first opening the closure.

Figure 38:
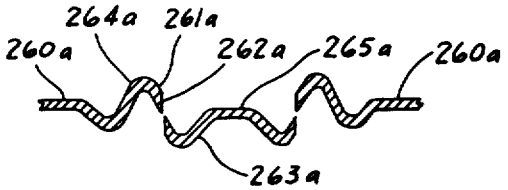
FIG. 38 is a partial cross-section in the area similar to FIG. 37, and showing a subsequent step in the method of press forming and cutting the metal of the end panel.
Figure 39:
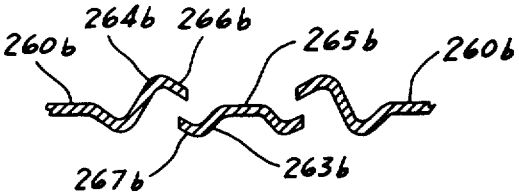
FIG. 39 is a partial cross-section similar to FIG. 37, and showing a later step in the method of press forming the metal of the end panel.
Figure 40:
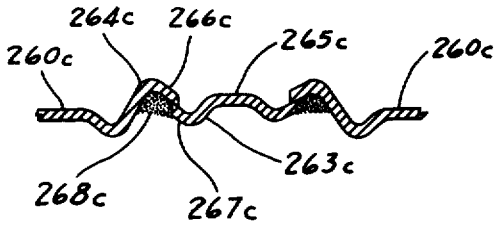
FIG. 40 is a partial cross-section in the area similar to FIG. 37, and showing a still later step in the method of press forming, and then adhesive sealing the metal of the end panel.

FIGS. 37, 38, 39, and 40 show cross-sections of a closure segment at a point similar to FIG. 35, and illustrate a simple method for forming the ductile metal material of a container top to make the closure segment larger than the opening from which it is cut. By press forming operations, including an initial bulge draw to provide enough material, the metal of top 260 is die formed to the contour in FIG. 37, forming ridges 264 having inner slopes 261, and closure segment 263 with center bulge 265. The cut is made at 262, shown dotted, in the next step. FIG. 38 shows the cuts at **262*a*, after which the segment 263*a* is moved down as shown so the edges clear. Successive forming gives the FIG. 39 contours in which the inner slopes of the walls of ridges 264*b* are raised upward as at 266*b*, thereby serving to make the opening smaller tha the width of the segment cut therefrom. The edges of the segment may also be bend down as at 267*b* to enlarge the segment to further increase the overlap and to make the angled surfaces parallel. In the final forming step, as shown in FIG. 40, the segment is raised to bring 266*c* and 267*c* together, and then adhesive sealant 268*c*** is applied to make the closure airtight. Optionally the closure may be sealed by laminar material secured by adhesive around the periphery of the opening to the metal of the container top externally of the opening.

The type of lift tab construction shown in FIG. 33 and in FIG. 41, in which the lift tab is attached by means such as an integral rivet to the segment itself near one edge, and whereby raising the lift tab initiates rupture of the sealant in one localized area through leverage, may also be used for any other shape or type of closure segment. For instance a lift tab can be used on the FIG. 16 design attached by rivet near the rim side of closure 97 to start rupture of a laminate or sealant near 94, and then the tab pushed downward to complete the opening.

Or a lift tab can be used in the FIG. 27 arrangement, attaching it near the rim side of portion 175. The FIG. 27 segment is defined by part score line and part cut through the material and with the size of the opening decreased at one point. This type can be made easier to open with a lift tab attached near the rim and near 175.

Figure 42:
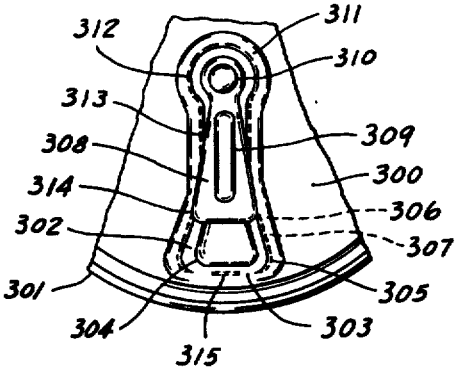
FIG. 42 is a partial plan view showing an alternative construction with the lift tab attached at the inner end of the closure.

FIG. 42 shows another preferred form in a partial plan view of container top 300 with rim 301. A closure 302 is cut from the material of the top, and with uncut section 303 for hinging attachment. A ridge 311 is formed around the periphery of the opening cut, and is hollow underneath at 306 where frangible sealant 307 seals the closure to the container top. The opening is made smaller than the segment, and the overlapping edge of segment 302 is 305. A lift tab 308 is provided to assist in opening the closure, and is attached to the inward end of the segment by integral rivet 310. Tab 308 has rounded edges giving stiffness and rib 309 which extends downward to prevemnt misalignment. Tab 308 is wider than the opening at 313 to 314 to provide against inadvertent opening from downward pressure.

To open the container the lift tab is raised and this bends down the edge of the segment at its inner end, starting rupture of the sealant, and releasing any internal pressure. The closure is then pushed on down by the lift tab, and the wider opening at 312 permits the end 314 of the tab to pass through and go below the container top, where it catches under the edge of the opening, holding it down flush. This prevents interference with the user's nose if drinking from the can. A depression 304 gives more space to grasp the end of the tab, after opening provides clearance for flow of liquid near the rim. Optionally, hinge connection 303 can have a score line at 315 to facilitate bending down, and along a line closer to the rim. 315 is shown on the underside to lessen possibility of break-off. Sealing is preferably by adhesive sealant, or a membrane may be used. The lift tab may be positioned off at an angle rather than on the center-line before opening, if desired.

Figure 43:
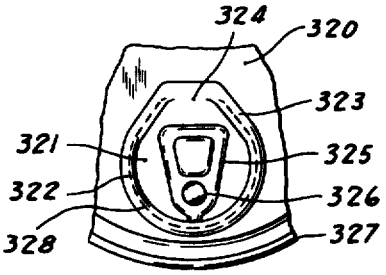
FIG. 43 is a partial plan view showing a very simple form of closure with a small lift tab to assist in opening.

FIG. 43 shows a simplified form of the invention. Container top 302, with rim 327, has closure 321, which is slightly larger at 328 than the opening 322, and is attached at the top by un-cut hinge section 324. The walls around the opening at 323 provide rounded edges and a hollow space underneath for a frangible sealant to seal the closure to the top against leakage. Lift tab 325 is attached to the closure by rivet 326, and provides leverage to initiate rupture of the sealant, and then both the closure and the tab are pushed on down below the surface of the top to complete the opening.

Referring again to the typical structure shown in FIG. 28, and also the variations in FIG. 18, it will be noted that FIG. 28 defines a very important invention, and one involving clearly defined general principles, and subject to variations in structure, but all in keeping with the invention. The principle structure comprises (a) an openable segment in the container top, or other wall, which is defined by a score line which extends almost all the way around the periphery of the segment except at one place where the score line is interrupted to leave an unscored section to serve as an integral hingeable attachment means to anchor the segment to the container top after opening, and with the segment hinged down within the container (b) an elongated lift tab which is hingeably attached to rivet means, and with the rivet means secured to the container top in a position just outward of the segment, but close to the score line, (c) the lift tab having a longer outer lift end extending over the container top beyond the segment and closely overlying the top, and a downward pressure exerting inner end extending partially over the segment in the region near the rivet, (d) and whereby manual raising of the outer lift end of the lift tab causes the inner end to exert high downward pressure against the segment and causes rupture of the score line, starting in the region near the rivet, and progressing on around the periphery, and effecting hinging of the segment down into the container to form an opening, and where it remains anchored to the top by the unscored section, and (e) whereby the lift tab may then be folded back flat against the container top to be out of the way, as when the user drinks from the container.

For most effective operation, and with minimum lifting force required to raise the tab, the segment is preferably of oval rounded shape, the score line groove is as deep as possible to give minimum residual material under the groove to be sheared, the inner downward pressure exerting end or nose is designed to effectively initiate the rupture and then to carry it progressively on around the periphery, and stiffening means are helpful both within the area of the segment and in the top near the rivet. The score line rupture starts as shear in the region near the rivet, then progresses down one side as further shear, and then around the side nearest the unscored section as shear plus bending plus tension stresses caused by the bending action.

In the structure shown in FIG. 28, it will be noted that openable segment 202, as defined by score line 196, preferably has a rounded periphery near the rim of the container, and such that the segment has a more or less oval shape. Lift tab 191 is secured to container top 190 by integral rivet 192, which is positoned just outward of score line 196, and with the score line curving around the rivet, a very advantageous arrangement. The lift tab has a lift ring at its outer end beyond the segment, and downward pressure exerting pair of inner extensions 194 and 195 to press down on openable segment 202 inward of the score line when the lift tab is raised. Manual partial raising of the lift ring results in initial rupture of the score line near the rivet. Once rupture is initiated over a section of score line, further extension of the rupture along the score line periphery of a segment takes very little pressure, particularly for a segment with the rounded oval contour. This further rupture is easily accomplished by additional raising of the lift tab to 90 degrees or beyond, and such that the segment is hinged down more or less vertically under the container top, and anchored permanently thereto by unscored hinge section 197. After opening, the lift tab is folded back close above the top where it is out of the way of the user's nose when drinking from the can, and with the segment remaining in it hinged down inner position.

FIG. 18 shows a similar opening system operating on the same principle, but for a segment held by adhesive along the periphery instead of a score line. FIG. 18 shows a single inner nose 109 for exerting high downward pressure as an alternative to the double nose arrangement of FIG. 28. Also FIG. 18 shows the use of a U-shaped cut in the flat material of the center section of the lift tab, and with the cut extending around and just outward of the head of the rivet, and with the open part of the U facing toward the pressure nose. This arrangement provides greater hingeability of the tab.

The provision of a U-shaped cut or lance around the rivet and in the material of the tab causes the tab, when raised, to hinge upward around an axis which is roughly tangent to the inner side of the rivet, and with the metal of the tab which is between the ends of the U acting as a hinge. This permits easy raising to a 90 degree angle or more, and with little resistance to bending by the material of the tab. This hinging structure is well known in the art, and is shown in three Khoury U.S. Pat. Nos. 3,322,296, 3,366,270, and 3,534,883, as well as others.

FIG. 28 also shows a bulge 201 which serves to provide a convenient means to optionally assist the lift tab by pushing down on the bulge with a finger during final propagation of the score line rupture. Such a supplementary push, however, was found to be advantageous only for the larger and less rounded shapes of segment, or where the score line groove was less deep, or the top was made of material that required a higher shear stress to rupture. It is not required for the standard sizes of beverage can end, and made preferably of aluminum alloy.

FIGS. 44, 45, 46, 47, 48, 49, 50 and 51 show a number of variations in structural details, and all in accordance with the basic structure of the invention. Since FIGS. 44 through 51 all have certain basic structural features that are generally common to each figure, such common features have been numbered using numbers having the same second and third digets for simplification of the explanations.

Figure 44:
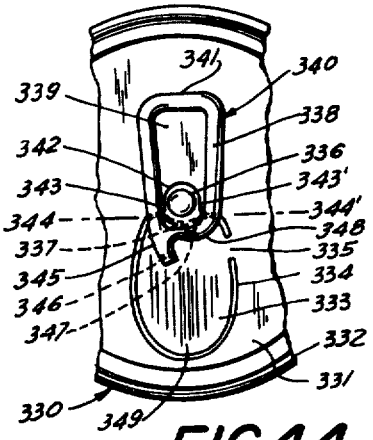
FIG. 44 is a partial plan view of a container top having a hingeable down openable segment and leverage tab opening means attached just outward thereof, and with a plurality of pressure contact means for effecting rupture along the score line.

FIG. 44 shows a modified structure in accordance with the invention. Container 330 has top 331 attached to the container body by rim 332. Within top 331 is openable segment 333 defined by score line 334, and with the score line is interrupted along its periphery by an unscored section 335, which forms an integral hingeable attachment means to anchor the segment to the top after opening. Elongated lift tab 340 is provided for manual opening of the segment, and is attached to the top by rivet means 336, preferably integrally formed from material of the top. Rivet 336 is positioned just outside the area of the segment but close thereto, and preferably with the score line curved around it as at 337. Leverage lift tab 340 has outer lift end 341 and extends out over top 331 and closely overlying it, and tab 340 has inner downward pressure exerting inner end 345 which extends partially over the segment in the region near the rivet. Tab 340 has inner flat region 339 and outer curled under edge 338, which extends around its periphery to give stiffness and a protective rounded edge. A plain lift tab, such as 340, is preferred to the ring type lift tab of FIG. 28 for this application to prevemnt the user from trying to pull the tab completely off due to his previous experience with the full tear out type of easy open top. FIG. 44 shows hingeable attachment means to the rivet to permit raising the tab 90° or more without placing undue strain on rivet or top material. This means comprises a U-shaped lance, or narrow slot, 342 which is cut through the 339 tab material and extends in an arc around the rivet on the side toward the tab lift end, and with the two sides 343 and 343' of the lance extending alongside the rivet to the final horizontal crosswise bend line, or axis of tab upward rotation at 344. This bend line is about tangent to the side of the rivet which faces toward the openable segment.

In FIG. 44 the inner pressure end 345 has one pressure exerting means 347 which projects slightly below curled edge 338, and to exert high downward pressure along the score line near 337 to initiate rupture. A second pressure means 346 does not project down as far as 347, and as rupture starts, 346 extends the rupture along the score line on the left side and on around the curve at the rim. Side shoulder 348 assists in bending down segment 333 into the container, and the bending action helps complete rupture along 334 to 335. The segment area may be crowned upward, as at 349, to provide partial stiffness, and make pressure point 346 more effective in transmitting the downward pressure to the rim.

Figure 45:
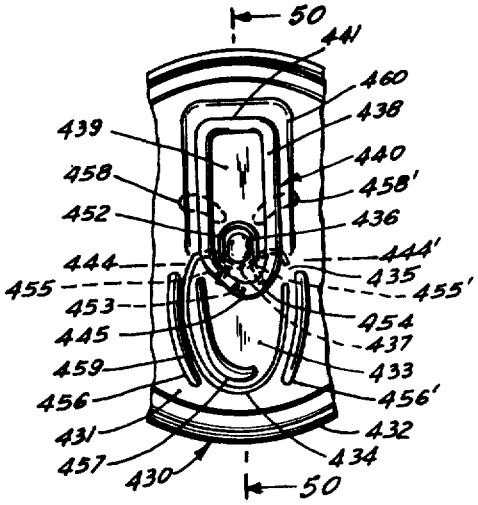
FIG. 45 is a partial plan view of an easy open top with leverage tab opening means in accordance with the invention, and including depression for the tab in the top, reinforcing ribs, and small radial score lines near where the integral rivet is attached.
Figure 50:
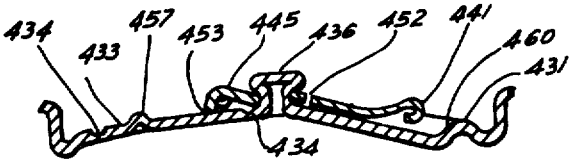
FIG. 50 is a partial cross-sectional view taken along line 50—50 of FIG. 45, and to show details of the structure.

FIG. 45 shows an exemplary form of the invention. A depressin 460 is formed in top 431 to help maintain lift tab 440 flush with the top when bent back after opening segment 433. U-shaped lance slot 452 provides hingeable connection of 440 to integral rivet 436, which is oval to prevent rotation of the tab and to make a stronger rivet against bending. Grooves 458 and 458' in top 431 also strengthen the rivet and the top itself in this region. Downward pressure nose 445 has contact means 453 projecting a little below curled edge 438, and 453 exerts downward pressure when tab end 441 is raised to start rupture of the score line at 437, and then to continue rupture around side 459. Two short radial score line grooves 455 and 455' make rupture at 437 take place with less pressure, since they weaken the surface of the metal, and as a result rivet 436 tilts upward more easily as the tab is raised, and this added deflection adds bending stresses to shear stress. This action is similar to the rabbit ears of U.S. Pat. No. 3,422,983. Rib 457 gives partial stiffness to the segment to insure transmittal of the downward pressure from 453 all the way to the rim and on around toward 435. Side 454 assists in hinging the segment down on unscored section 435, and the right side of the oval segment 433 is quite straight, such that the segment bends down easily, the bending action mainly causing score line rupture on the right side. Upwards ribs 456 and 456' stiffen the top and protect the user against being cut by the sharp edges of the opening. FIG. 50 is a paraial cross-sectional view taken along line 50—50 of FIG. 45, and the part numbers correspond. Tab end 441 tilts upward slightly.

Figure 46:
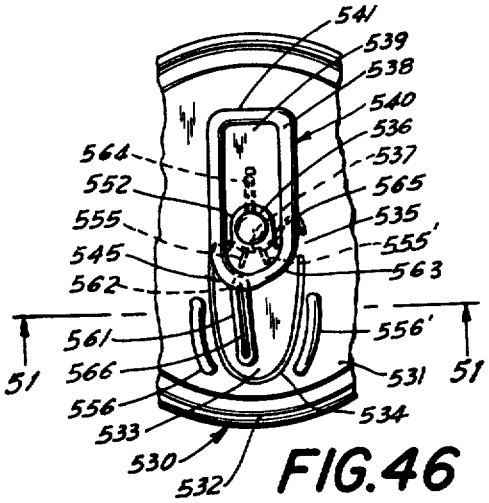
FIG. 46 is a partial plan view of a similar easy open top, and with off-set positioning of the unscored attachment section that anchors the segment to the top after opening, and with a special type of reinforcing rib to lower the force needed to open.
Figure 51:
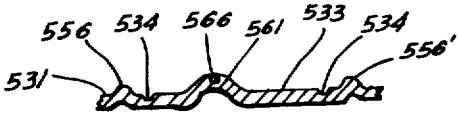
FIG. 51 is a partial cross-sectional view taken along line 51—51 of FIG. 46, and to show details of the score line and rib structure, and this structure to reduce the force required for the propagation of rupture.

FIG. 46 shows another variation in the invention. In FIG. 46 the periphery of the segment extends around rivet 536 and upward further on one side at 565. This positions the unscored hinge section 535 further away from the downward pressure nose 545. Straight rib 561 is formed in segment 533 to stiffen it, especially along the left side, and the curled edge 538 of nose 545 presses directly against the top of rib 561 when lift tab 540 is raised to open the segment. FIG. 51 is a partial cross-sectional view taken along line 51—51 in FIG. 46, and shows rib 561. Advantageously rib 561 may have a score line groove 566 formed in the upper side of the rib as shown, or in the underside. When high downward pressure is exerted on rib 561 by end 545, it tends to bend the rib and adjoining material of segment 533 downward, and this bending is made much easier by groove 566. As the rib bends downward, it creates bending stresses in the corner of score line groove 534 along the left side, which bending stresses combine with the downward shear stresses to make rupture along the score line on the left side take place using lower manual lifting force on tab 540. Groove 561 is shallower than groove 534 so it does not rupture. Shoulder 563 rubs against 533 as the tab is raised to its upper position and helps to hinge the segment down into the container, and also assists rupture along the score line on the almost straight right hand side by the bending action. Groove (or rib) 564 in top 531 helps to stiffen both top and rivet.

Figure 47:
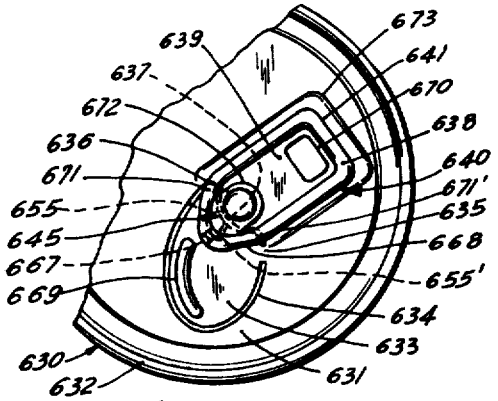
FIG. 47 is a partial plan view showing an oval openable and permanently attached segment, and with the lift tab arranged at an angle for better leverage in opening and less interference of the tab with the user after opening is completed.

FIG. 47 shows an arrangement of the invention in which lift tab 640 is positioned at an angle relative to the oval segment 633. Advantages are easier opening, and after opening the folded back tab is off-center so as not to interfere with the user's nose. Depression 673 in top 631 permits flush storage of tab after opening. The tab has small opening 670 at lift end 641 to guide the finger when lifting. Downward pressure exerting tab inner end 645 presses a slightly downward extending pressure contact means 667 against the segment to start rupture along the score line at 637, and U-shaped lance slot 672 insures raising the tab to beyond 90 degrees. The width of the segment between points 671 and 671' is sufficient to permit nose 645 to enter the opening as the segment hinges down into the container. Rib 669 gives partial stiffness to the segment. Since rivet 636 is off to one side instead of on the center-line, nose 645 through projection 667, assisted by side shoulder 668, gives a strong downward hinging action to the segment as it is forced downward, this hinging action causing rapid extension of the initial rupture, which starts near the rivet at 637, on around the left side of the segment. The score line on the right side ruptures mainly by the bending down of the segment, rather than by shear stresses. The opened segment is anchored under the top by unscored section 635 after the lift tab is folded back into depression 673.

Figure 48:
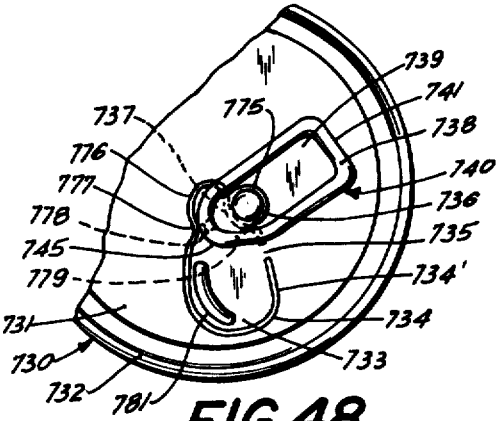
FIG. 48 is a partial plan view showing an easy openable segment with the leverage lift tab at an angle, and exerting downward pressure near the score line of a small loop of the segment near the region where the leverage tab is secured just outward of the openable segment.

FIG. 48 shows still another structure in keeping with the invention, and with angular positioning of lift tab 740. The score line 734 which defines openable segment 733 is necked inward at 777, not far from rivet 736. There is a small arc connection of score line from 777 to 737, where the score line curves around the rivet. Lift tab 740 has U-shaped lance slot 775 for hingeable attachment means to rivet 736, and has downward pressure exerting inner nose 745, and with slightly downward extending pressure contact means 778 to press against 733 when the outer lift end 741 is raised manually. Contact means 778 is positioned very close to and just inward of the score line at 777, so downward pressure on 778 causes initial rupture at 777, rather than at 737. Further raising of the lift tab extends the rupture around arc 776 to unscored hinge section 735, and also downward around the left side of the segment, which is partially stiffened by rib 781. Rupture along side 734' is largely by bending action. Underside of nose 745 at 779 also assists the downward pressure exerted by 778 during the opening operation.

Figure 49:
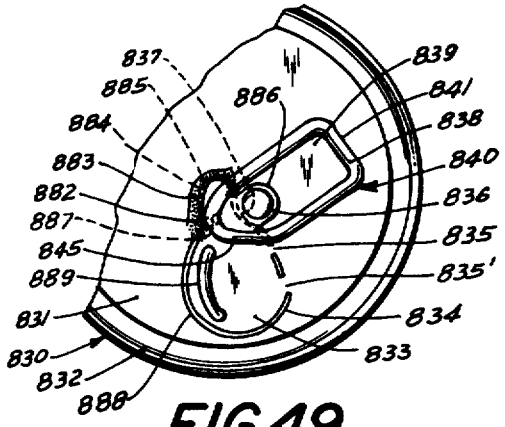
FIG. 49 is a partial plan view of an easy open container top similar to FIG. 48, but with the small loop comprising a cut through section which is adhesively sealed, rather than score line, and to reduce the forces required for initial rupture.

FIG. 49 shows a similar structure to FIG. 48, but with necked in point at 882, and with the section of the periphery of the segment from 882 around arc 883 to 837 near rivet 836 arranged for easier initial rupture by adhesive sealing instead of a score line. The metal along this arc is first cut through, and then the outer curved edge 883 is press formed inward to provide a small overlap, as at 884, to resist upward pressure caused by carbonated contents. A line of friable adhesive 885 on the underside serves to seal the crack againstleakage. When lift tab 841 is raised, pressure contact means 887 on inner tab end 845 moves downward and ruptures the arc of adhesive, and with lower pressure being required as compared with rupturing a score line, which takes 25 to 30 pounds pressure to initiate. Lance 886 assists in giving hingeable attachment of 840 to rivet 836. After the adhesive ruptures, a further pressure of 5 to 8 pounds is sufficient to cause rupture of the score line 834 on around side 888 of the periphery, with rib 889 assisting. The right side then ruptures, mainly by bending, up to hingeable attachment means 835'. Two unscored section attachment means 835 and 835' may be provided as shown, or one will serve.

In the claims the term "openable segment" means a partially removable area of any shape, and it is specified as being in the container top as this is the position in which opening is normally done, but the container may be stored with the top wall in this or any other position.

In the claims the term "frangible adhesive sealant" covers any type of sealant that will adhere to the material of the top and segment, and that can be ruptured to open. The adhesive used must be compatible with the material packaged in the container. Preferred adhesive sealants are the plastisols, as they form a semi-flexible sealing line that can be ruptured at a focal point without requiring excessive force. Plastisol is a dispersion of fine particle size PVC type resin in a plasticizer, and requires heat curing. Foamed plasticizer may be used. Or the adhesive may be hot melt, containing waxes, cellulose esters and ethers, polyvinyl esters and acetals, and certain polymides, etc.

Sealing may be by an adhesively attached membrane or thin laminar material. The membrane may be adhered by pressure sensitive adhesive, or other type.

The container top, the leverage lift tab, and the rivet securement means may each be made of aluminum alloy, steel, or plastic. The lift tab in any of the species may be of metal or plastic, and may be attached by rivet, integral rivet, welding, or other means.

The term "score line" refers to a weakened line formed by thinning the material. The score line may be on the outer surface of the container top, or on the underside of the top, or on both sides, as described in my U.S. Pat. No. 3,411,661. When a supplementary score line groove is made on the other side, such as the underside when the main score line groove is on the top, it may be formed by die pressing the groove, or by merely re-working the material to form a shallow groove which is sufficient to give stress concentration. A supplementary underside groove is advantageous in the invention in the region near the rivet securement means, and along the side of the segment which is opposite to the side having the unscored hinge section, and to make score line rupture easier.

In the claims the term "generally rounded corner shape" is an area having substantially rounded ends or corners, especially at the end toward the border of the container top, and the sides may be rounded or may be partially straight, and the inner end is usually indented where the leverage lift tab is attached to the top just outward of the segmental area.

In the claims where the leverage lift tab is positioned at an angle relative to the centerline drawn through the segmental area, this angle is generally acute, especially on the smaller size container tops where space is limited.

It will be apparent that while I have shown anddescribed the invention is several preferred forms, changes may be made without departing from the scope of the invention, as sought to be defined in the following claims.

What I claim is:

1. An improved easy open container having a top with easy opening means therein, and said easy opening means comprising, an openable segment of generally rounded corner shape in said container top and with said segment defined by a weakening score line which extends most of the way around the periphery of said segment, but with said score line interrupted at a point to leave an unscored section of said periphery, and said unscored section providing an integral hingeable attachment means to anchor said segment to said container top after opening of said segment, said openable segment having an outer end extending toward the peripheral border of said container top, and an inner end extending toward the inner region of said top, and said unscored section of said score line positioned along one side of said segment, and being closer to said inner end than to said outer end of said segment, a leverage lift tab for manual opening of said openable segment, and having rivet securement means positioned along its length to permanently secure it to said container top, and with flexible upwardly hingeable connection means between the main body of said lift tab and said rivet, and with said rivet securement means positioned on said top just outward of said openable segment and close to said score line and in the region of said inner end of said segment, and said lift tab having a longer outer lift end extending beyond said segment and closely overlying said top mainly outward of said segment, and having s shorter inner downward pressure exerting end means extending over only a part of said segment and said part located in its inner end region, and said inner downward pressure exerting end means of said lift tab having pressure contact means whereby when said outer lift end of said lift tab is manually raised, said pressure contact means will tilt downward and exert high downward pressure on said segment and cause rupture along said score line, and will bend said segment down into said container where it remains anchored to said top by said hingeable unscored section, and whereby an opening is formed in said container top suitable for outflow of the contents of said container.

2. An easy open container as defined in claim 1 wherein means are provided to enable manual folding back of said leverage lift tab after opening to close to its original position just above and overlying said container top.

3. An easy open container as defined in claim 1 wherein said inner downward pressure exerting end means has a pressure contact means for exerting downward pressure on said openable segment to initiate rupture of said score line near said rivet securement means, and separate pressure contact means to extend the rupture around the periphery of said segment, and to hinge said segment down into said container, and thereby to form an opening in said container top.

4. An easy open container as defined in claim 1 wherein said rivet securement means is an integral rivet formed from the material of said container top.

5. An easy open container as defined in claim 1 wherein a portion of said score line curves close to and partially around said rivet securement means.

6. An easy open container as defined in claim 1 wherein said container top is made of aluminum alloy.

7. An easy open container as defined in claim 1 wherein said container top is made of steel.

8. An easy open container as defined in claim 5 wherein in the region where said score line curves around said rivet securement means there are two short closely spaced score lines each starting at and intercepting said curved score line, and each extending a short distance into said segment, and the extensions being generally radial with respect to said rivet securement means.

9. An easy open container as defined in claim 1 wherein said leverage lift tab is constructed with relatively flat material in its central area where said rivet securement means is attached thereto, and wherein there is a U-shaped through cut in said flat material and with said cut just outward of the head of said rivet, and with the open end of said U-shaped cut facing toward said inner downward pressure exerting end means, and with said cut providing a more hingeable means for attachment of said leverage lift tab to said rivet securement means.

10. An easy open container as defined in claim 1 wherein there is a depression formed in said container top in the region under said longer outer lift end of said leverage lift tab, and into which said outer lift tab end is at least partially deposed both before and after opening of said openable segment.

11. An easy open container as defined in claim 1 wherein there is an area within said openable segment in which the material of said segment is formed with contours which are off-set relative to the general plane of said container top.

12. An easy open container as defined in claim 11 wherein said off-set contours comprise a substantially straight rib positioned along and not far from the side of said segment which is away from said unscored section, and in which rib there is a weakening groove extending along the upper portion of said rib, and whereby when said segment is opened by downward pressure of said pressure contact means said rib bends downward and bending stresses are formed in said score line along this side of said segment.

13. An easy open container as defined in claim 1 wherein said rivet securement means is positioned on said top outward of said openable segment and in the general region of said interior end of said segment, and is positioned near said inner end but a short distance off toward one side of said rounded corner segment, and close to said score line, and wherein said leverage lift tab is positioned at an acute angle relative to the longitudinal axis of said generally oval form of said openable segment, and with said unscored section of segment periphery positioned on the same side of said segment as the side to which said lift tab is set off at an angle, and positioned further over on this side than said rivet securement means.

14. An easy open container as defined in claim 13 wherein the peripheral path of said score line has a small inward off-set extending toward the interior region of said segment at a point near the said inner end of said segment and not far removed from said rivet securement means position, and on the other side of said rivet means from said unscored section, and wherein there is a small outward bulge in the side of said segment between said inward off-set and the region of said score line adjacent said rivet means, and wherein pressure contact means on said inner downward pressure exerting end means is positioned close to the inner side of said score line at said inward off-set, and whereby when said outer lift end of said lift tab is raised to open said openable segment, rupture of said score line is initiated at said off-set, and then progresses in both directions along the periphery of said score line, and said segment is hinged down into said container to form an opening.

15. An easy open container as defined in claim 1 wherein said unscored section of periphery is on one side of said segment, and on the opposite side of said segment and close to said rivet securement means position, a short section of the score line is replaced by a through cut in the material of said top, and wherein the through cut is sealed against leakage by frangible sealant means applied on the underside, and wherein when said outer lift tab end is raised to open said openable segment, initial rupture takes place along the through cut frangible sealant sealed section.

16. An easy open container as defined in claim 1 wherein the main body of said rivet securement means has a cross-section which is non-circular and has an elongated shape, and wherein an opening is provided in the interior region of said leverage lift tab at the point where said lift tab is attached to said rivet securement means, and with the configuration of said opening conforming to the size and shape of said elongated cross-section of said rivet securement means.

17. An easy open container as defined in claim 16 wherein said rivet securement means has the elongated dimension of its cross-section extending in a direction which is generally parallel to the length of said leverage lift tab.

18. An easy open container as defined in claim 1 wherein said score line which defines said openable segment comprises a score line groove on one surface of said container top, and wherein there is also score line grooving along at least part of said periphery of said openable segment on the other surface of said container top, and with the grooving on the two surfaces in substantial alignment with each other.

19. An easy open container as defined in claim 3 wherein said separate pressure contact means on said inner downward pressure exerting end means includes a downward pressure exerting contact means which is positioned just above said openable segment and off-center and toward one side of said openable segment, and which side is across from the side where, or near where, said unscored integral hingeable attachment means is positioned, and whereby the downward pressure to extend rupture of the score line along this side during the opening operation is concentrated nearer to the score line on this side.

* * * * *